US009511825B1

(12) United States Patent
Henning et al.

(10) Patent No.: US 9,511,825 B1
(45) Date of Patent: Dec. 6, 2016

(54) APPARATUS FOR SUPPRESSING VORTEX-INDUCED VIBRATION OF A STRUCTURE WITH REDUCED COVERAGE

(75) Inventors: Dean Leroy Henning, Richmond, TX (US); Donald Wayne Allen, Richmond, TX (US); William Andrew West, Friendswood, TX (US)

(73) Assignee: VIV SOLUTIONS LLC, Richmond, TX (US)

( * ) Notice: Subject to any disclaimer, the term of this patent is extended or adjusted under 35 U.S.C. 154(b) by 466 days.

(21) Appl. No.: 13/343,408

(22) Filed: Jan. 4, 2012

Related U.S. Application Data

(60) Provisional application No. 61/429,828, filed on Jan. 5, 2011.

(51) Int. Cl.
*B63B 21/66* (2006.01)

(52) U.S. Cl.
CPC ..... *B63B 21/663* (2013.01)

(58) Field of Classification Search
CPC ..... Y02E 10/727; B63B 21/663; E02B 2017/0091; E02D 5/60; E02D 5/226; F16F 15/02
USPC ..... 405/195.1, 211, 216, 212
See application file for complete search history.

(56) References Cited

U.S. PATENT DOCUMENTS 3,224,406 A * 12/1965 Clark ..... B63B 21/663 114/243
3,899,991 A * 8/1975 Chatten ..... B63B 21/663 114/243
4,200,999 A * 5/1980 Latimer ..... B63B 21/663 114/243
4,398,487 A * 8/1983 Ortloff ..... B63B 1/32 114/243
4,657,116 A * 4/1987 Gardner ..... F16F 15/00 114/312
4,722,367 A * 2/1988 Swink ..... F16L 57/00 138/106
5,102,265 A * 4/1992 Dokmo ..... E02B 17/0026 405/195.1
5,275,120 A * 1/1994 Ruffa ..... B63B 21/663 114/243
5,460,463 A * 10/1995 Smith ..... E02D 5/60 405/212
5,573,354 A * 11/1996 Koch ..... E02D 5/60 405/216
6,019,549 A * 2/2000 Blair ..... E01D 19/02 24/460
6,048,136 A * 4/2000 Denison ..... E21B 17/01 114/243
6,067,922 A * 5/2000 Denison ..... B63B 21/663 114/243
6,179,524 B1 * 1/2001 Allen ..... B63B 21/502 114/263
6,347,911 B1 * 2/2002 Blair ..... E01D 19/02 24/462
6,401,646 B1 * 6/2002 Masters ..... B63B 21/502 114/243

(Continued)

OTHER PUBLICATIONS

Allen, D. W., et al., "Henning Devices: A new class of VIV suppression apparatus for offshore tubulars", Offshore Technology Conference 19881, (2009), 1-9.

(Continued)

*Primary Examiner* — Matthew R Buck
*Assistant Examiner* — Edwin Toledo-Duran
(74) *Attorney, Agent, or Firm* — Blakely Sokoloff Taylor & Zafman LLP

(57) ABSTRACT

An apparatus including a body dimensioned to surround a structure capable of experiencing a VIV, the body having a first section and a second section capable of being separated and positioned around the structure. The apparatus further including a blade member extending from the body, the blade member dimensioned to suppress the VIV of the structure when the body is positioned around the structure. A method of suppressing VIV about a structure by positioning a plurality of VIV suppression devices around the structure and wherein the plurality of VIV suppression devices cover less than 70% of a section of the structure.

16 Claims, 18 Drawing Sheets

(56) References Cited

U.S. PATENT DOCUMENTS 6,695,540 B1 * 2/2004 Taquino ..... 405/216
6,755,005 B2 * 6/2004 Czachor ..... F01D 25/24 52/630
6,896,447 B1 * 5/2005 Taquino ..... F15D 1/10 114/243
7,147,402 B2 * 12/2006 Edfeldt ..... F16L 57/02 405/159
7,458,752 B2 * 12/2008 Esselbrugge ..... B63B 21/502 114/243
7,600,945 B2 * 10/2009 Burgess ..... B63B 21/502 114/243
7,845,299 B2 * 12/2010 Masters ..... F15D 1/10 114/243
8,475,085 B2 * 7/2013 Masters ..... E21B 17/01 405/216
8,511,245 B2 * 8/2013 Dehne ..... F16L 1/123 114/243
8,579,546 B2 * 11/2013 Masters ..... B29C 45/14311 405/216
8,944,722 B1 * 2/2015 Allen ..... E02B 17/0017 405/216
2003/0074777 A1 * 4/2003 McMillan ..... B63B 21/502 29/428
2006/0153642 A1 * 7/2006 Esselbrugge ..... B63B 21/502 405/216
2006/0280559 A1 * 12/2006 Allen ..... B63B 21/502 405/216
2007/0104542 A1 * 5/2007 Somerville ..... B63B 21/663 405/224.1
2007/0140797 A1 * 6/2007 Armstrong ..... E21B 17/01 405/224.2
2007/0231077 A1 * 10/2007 Burgess ..... B63B 21/502 405/216
2008/0025800 A1 * 1/2008 Watkins ..... 405/216
2008/0050181 A1 * 2/2008 Masters ..... E21B 17/01 405/211
2008/0236469 A1 * 10/2008 Masters ..... F15D 1/10 114/243
2009/0185867 A1 * 7/2009 Masters ..... F16L 1/123 405/216
2010/0181064 A1 * 7/2010 Knobloch et al. ..... 166/99
2011/0200396 A1 8/2011 Allen et al.

OTHER PUBLICATIONS

Lee, L., et al., "Blade Henning devices for VIV suppression of offshore tubulars", Proceedings of OMAE: 28th International Conference on Ocean, Offshore and Arctic Engineering, Shell Global Solutions (US) Inc., (2009), 1-6.

* cited by examiner

APPARATUS FOR SUPPRESSING VORTEX-INDUCED VIBRATION OF A STRUCTURE WITH REDUCED COVERAGE

CROSS-REFERENCE TO RELATED APPLICATION

The application is a non-provisional application of U.S. Provisional Patent Application No. 61/429,828, filed Jan. 5, 2011, and incorporated herein by reference.

FIELD

Devices for suppressing a vortex-induced vibration of a tubular structure, in particular devices capable of suppressing the vortex-induced vibration of a tubular structure with reduced tubular coverage.

BACKGROUND OF THE INVENTION

A difficult obstacle associated with the exploration and production of oil and gas is management of significant ocean currents. These currents can produce vortex-induced vibration (VIV) and/or large deflections of tubulars associated with drilling and production. VIV can cause substantial fatigue damage to the tubular or cause suspension of drilling due to increased deflections. Various types of VIV suppression devices, for example helical strakes and fairings, can be attached to the tubular in an effort to suppress the effects of VIV on the tubular. While helical strakes, if properly designed, can reduce the VIV fatigue damage rate of a tubular in an ocean current, they typically produce an increase in the drag on the tubular and hence an increase in deflection. Thus, helical strakes can be effective for solving the vibration problem at the expense of worsening the drag and deflection problem.

Another solution is to use fairings as the VIV suppression device. Typical fairings have a substantially triangular shape and work by streamlining the current flow past the tubular. A properly designed fairing can reduce both the VIV and the drag. Fairings can be made to be free to weathervane around the tubular in response to changes in the ocean current.

An issue with both helical strakes and fairings is their cost. In order to be effective, helical strakes must typically cover about 85-90 percent or more of each section of the tubular requiring suppression. Fairings typically require coverage of 70 percent or more of each section requiring suppression. This results in a large number of fairings and strakes for a typical application, which can be very expensive and the added weight makes running and retrieving tubulars from the sea floor difficult. Even more expensive is the cost associated with retrofitting suppression devices underwater, which requires expensive installation costs for each unit installed.

BRIEF DESCRIPTION OF THE DRAWINGS

The embodiments disclosed herein are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION OF THE INVENTION

In this section we shall explain several preferred embodiments with reference to the appended drawings. Whenever the shapes, relative positions and other aspects of the parts described in the embodiments are not clearly defined, the scope of the embodiments is not limited only to the parts shown, which are meant merely for the purpose of illustration. Also, while numerous details are set forth, it is understood that some embodiments may be practiced without these details. In other instances, well-known structures and techniques have not been shown in detail so as not to obscure the understanding of this description.

As previously discussed, VIV suppression devices such as fairings and strakes have a high coverage density, meaning they must cover a substantial portion of the underlying structure to suppress VIV. In this aspect, the use of such devices becomes expensive and running and retrieving tubulars from the sea floor with fairings attached becomes difficult due to the added weight of the fairings. Accordingly, VIV suppression devices which perform well at lower coverage densities and may replace fairings and/or strakes are disclosed herein.

Figure 1A:
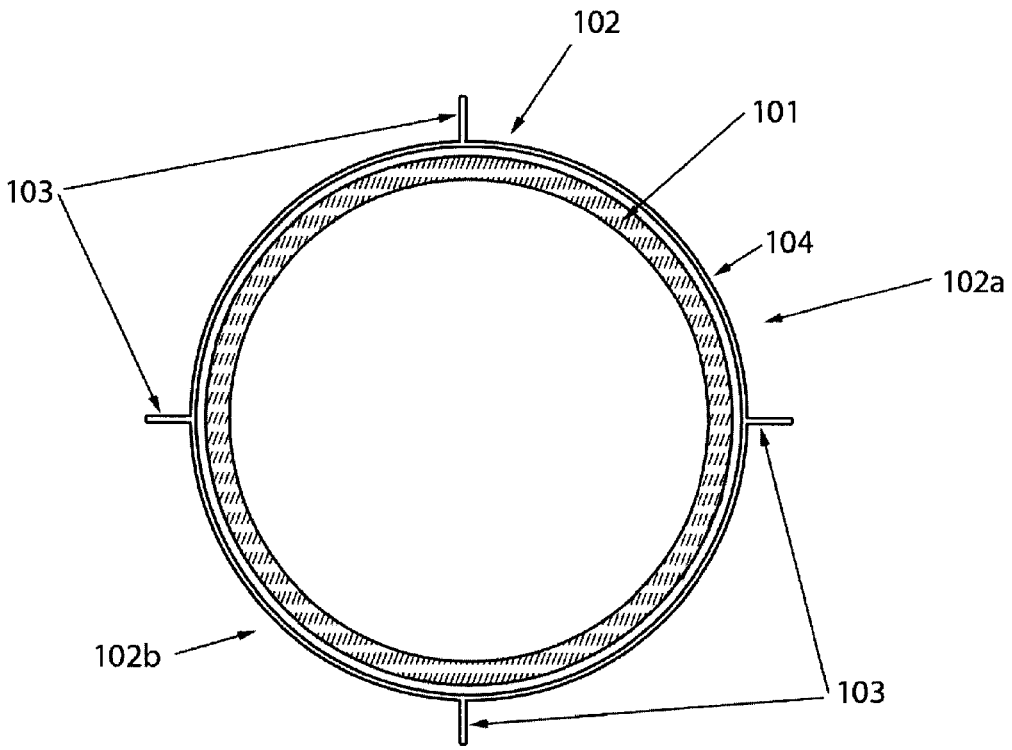
FIG. 1A illustrates a cross-sectional top view of an embodiment of a VIV suppression device.

FIG. 1A illustrates a cross-sectional top view of an embodiment of a VIV suppression device. VIV suppression device 102 may include body 104 having blades 103 extending therefrom. In some embodiments, body 104 is substantially cylindrical. Alternatively, body 104 may have any shape sufficient to surround a structure experiencing VIV, for example, a square, rectangular or triangle shape. Blades 103 may extend along a length dimension of body 104 and extend outward from body 104. Although four blades 103 are illustrated in FIG. 1A, it is contemplated that any number of blades suitable for suppressing VIV of tubular structure 201 may be used. Blades 103 may have a variety of shapes but should be sufficiently blunt such that oncoming current flow separates at, or near, the tip of the blade. Representatively, in this embodiment, blades 103 have an elongated, substantially rectangular cross sectional shape that is sufficiently narrow to separate oncoming current flow. For example, blades 103 may be formed by plate like structures. Alternatively, blades 103 may have other shapes such as a triangular, elliptical or circular shape.

All of blades 103 may extend the same distance from body 104 or they may extend different distances from body 104. For example, blades 103 may extend a distance from body (i.e. a length) that is substantially equal to about 3 percent of the diameter of tubular 101 to about 50 percent of the diameter of tubular 101, for example, from about 10 percent of the diameter of tubular 101 to about 25 percent of the diameter of tubular 101. Blades 103 may be the same height as body 104 or a different height. VIV suppression device 102 may range in height from about ½ to about 20 times the tubular diameter, for example from about ½ to about 3 times the tubular diameter. A diameter of VIV suppression device 102 will range in size from at least 100 percent of the diameter of tubular 101 to about 150 percent of the diameter of tubular 101.

In some embodiments, blades 103 are integrally formed with body 104 as a single unit. In other embodiments, blades 103 are separate structures that are attached to body 104. For example, blades 103 may be attached to body by inserting them into rings positioned adjacent body 104 that have receptacles for receiving blades 103. The rings may or may not be temporarily locked to tubular structure 101 or adjacent collars during installation.

VIV suppression device 102, including blades 103, may be molded, welded, bent, cast, glued, or otherwise formed with manufacturing techniques as are known in the art. VIV suppression device 102 may be made of metals such as steel, aluminum or metal alloys, polymers such as polyethylene, ABS, PVC, or other plastic material, or composite materials such as fiberglass or carbon fiber composites, or other conventional materials including wood or foam. In addition, copper, antifouling paint or other antifouling measures (e.g. copper mixed with a material on the inner and/or outer surface of the device or adjacent collars) can be used to mitigate marine growth about VIV suppression device 102. Blades 103 can be made of the same material as body 104 or a different material.

In some embodiments, body 104 of VIV suppression device 102 is one continuous cylindrical piece that slides over an end of tubular 101. In other embodiments, VIV suppression device 102 may body 104 divided into sections that can be separated to facilitate placement of VIV suppression device 102 around tubular 101. Representatively, VIV suppression device 102 may include first section 102A and second section 102B. First section 102A and second section 102B may be separated so that they can be opened and closed around tubular 101. Once sections 102A and 102B of VIV suppression device 102 are placed around tubular 101, they may be secured together using, for example, a band as illustrated in FIG. 1D.

Figure 1B:
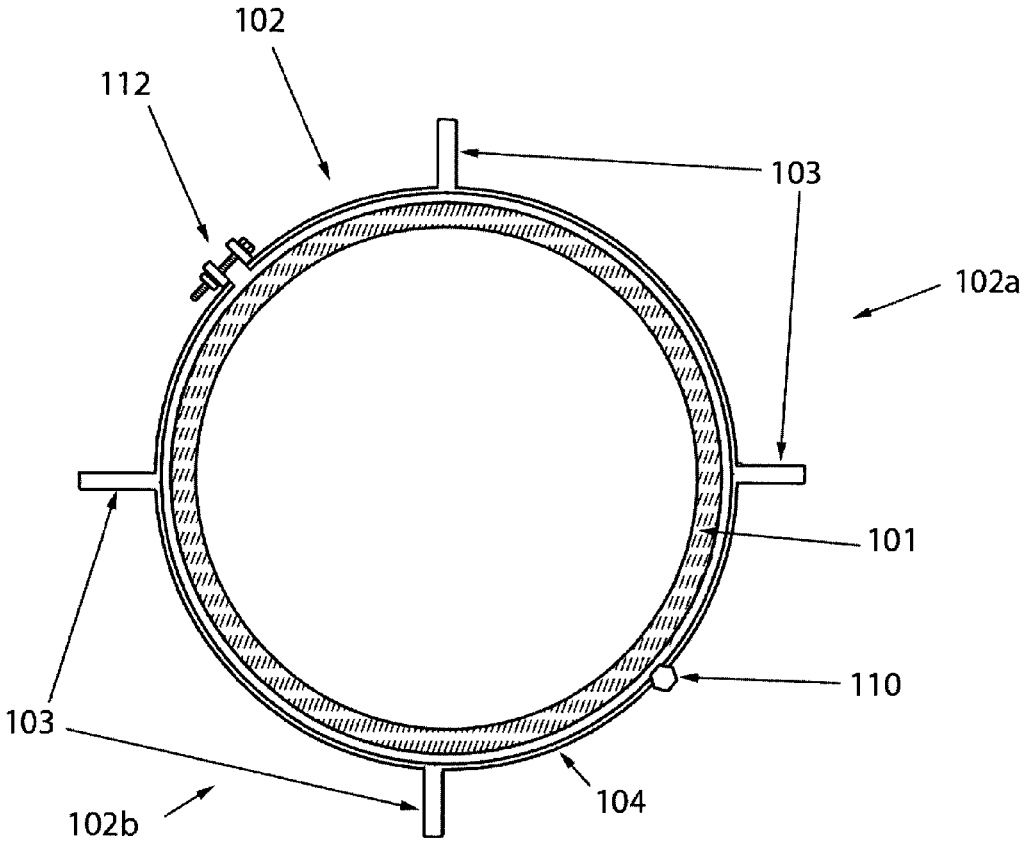
FIG. 1B illustrates a cross-sectional top view of another embodiment of a VIV suppression device.

FIG. 1B illustrates an embodiment where hinge 110 and attachment mechanism 112 are positioned along openings formed in the body portion 104 of VIV suppression device 102. In particular, first section 102A and second section 102B may be pivotally connected to one another by hinge 110 attached to adjacent ends of first section 102A and second section 102B so that VIV suppression device 102 may be opened and closed around tubular 101 in a clam shell like manner. Once VIV suppression device 102 is placed around tubular 101, the opposing ends of first section 102A and second section 102B may be secured to one another using an attachment mechanism 112, such as a bolt, clip, clamp, bracket, or the like. Hinge 110 and attachment mechanism 112 may be exterior to the surface of VIV suppression device 102, or substantially between VIV suppression device 102 and tubular 101 in a closed position.

Figure 1C:
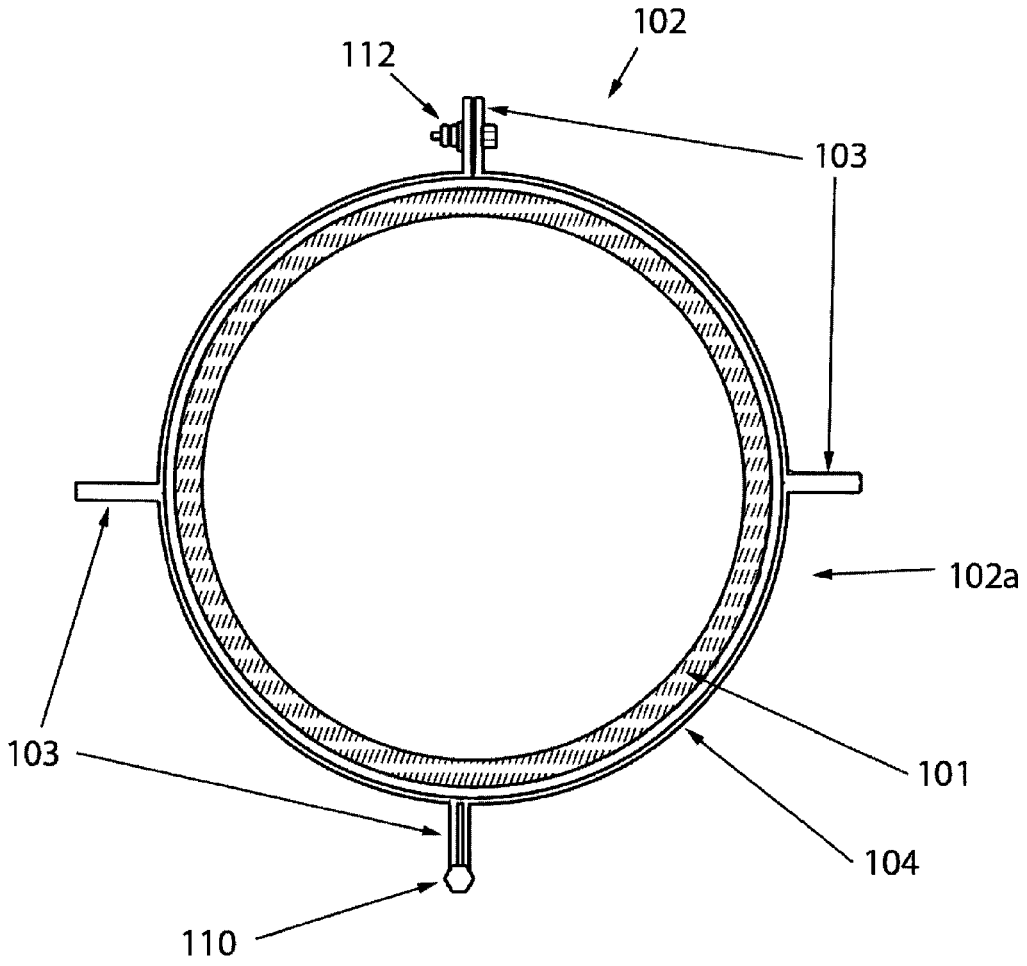
FIG. 1C illustrates a cross-sectional top view of another embodiment of a VIV suppression device.
Figure 1D:
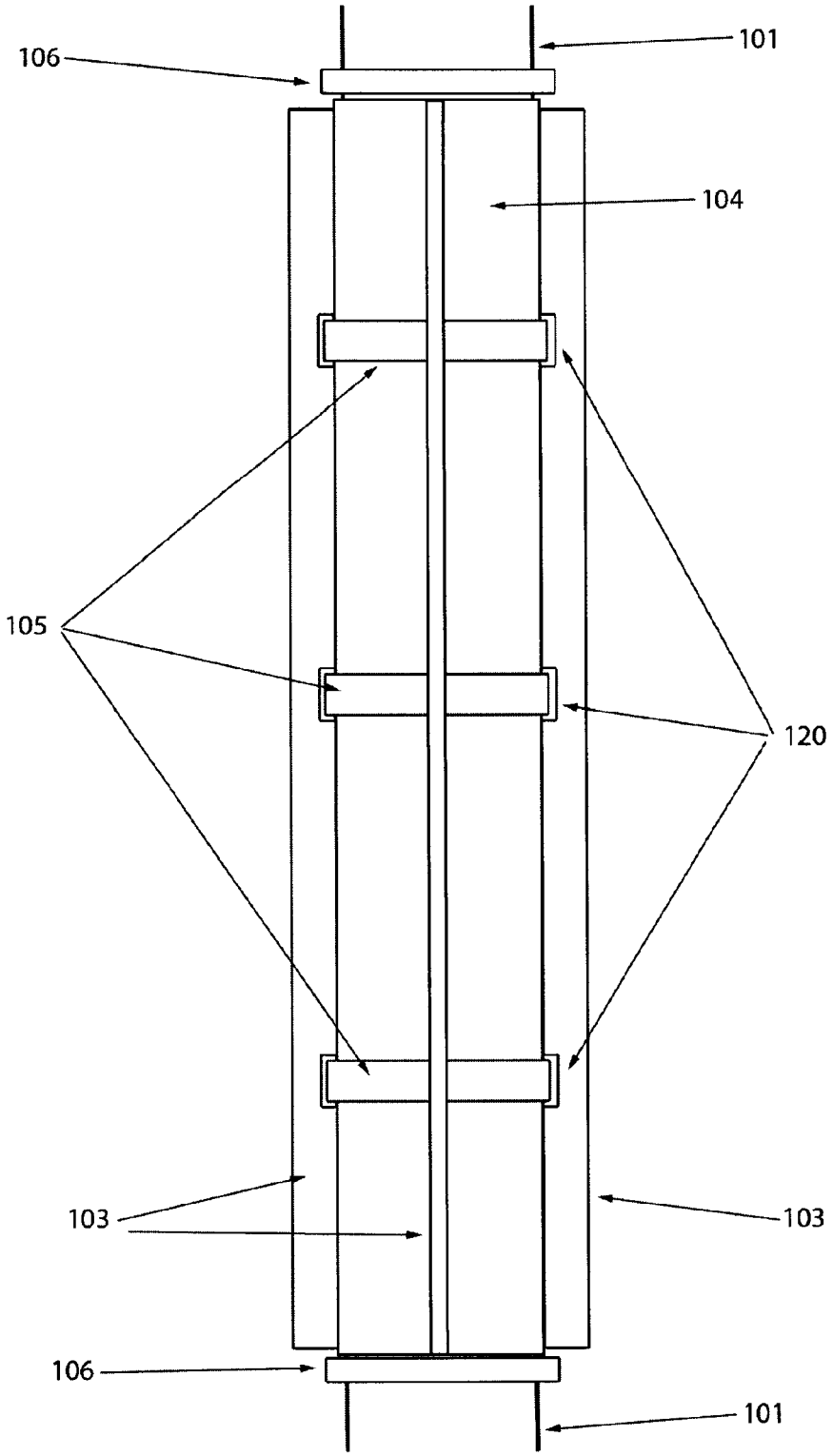
FIG. 1D illustrates a side view of the VIV suppression device of FIG. 1A.

In still further embodiments, attachment mechanism 112 and hinge 110 may be positioned along opposing blades 103 as illustrated in FIG. 1C. In particular, sections 102A and 102B may include blades 103 extending from each end. Hinge 110 may be attached to blades 103 at the adjacent ends of sections 102A and 102B and attachment mechanism 112 may be attached to blades 103 at the opposing adjacent ends of sections 102A and 102B. In some embodiments, the end blades 103 may be half the width of center blades 103 so that when they are aligned with one another, the total width is substantially equivalent to one of the center blades.

More than one hinge 110 and attachment mechanism 112 can be present on VIV suppression device 102 or its blades 103, and VIV suppression device 102 can be divided into any number of sections around the circumference of tubular 101. Blades 103 can vary in geometry (shape and size), for example, to accommodate the hinge 110 or the attachment mechanism 112. Attachment mechanism 112 may consist of mechanical fasteners such as bolts, screws, nuts, clamps, latches welds, etc. or may consist of chemical fastening or other suitable means.

FIG. 1D illustrates a side view of the VIV suppression device of FIG. 1A. The VIV suppression devices illustrated in FIG. 1B and FIG. 1C would look substantially the same except that hinges 110 and/or attachment mechanisms 112 would be positioned along the height dimension of body 104 or blades 103. VIV suppression device 102 is shown positioned around tubular 101 and restrained from axially sliding by collars 106. From this view, it can be seen that sections 102A, 102B of VIV suppression device 102 are held together by bands 105 which are inserted into slots 120 through blades 103. It is noted that although two sections 102A, 102B are discussed, VIV suppression device may be separated into any number of sections, with the sections held together using bands 105. Adjacent sections may be attached to one another and/or aligned in any suitable manner (e.g. secured with a bolt, hinge or the like), however it is contemplated that bands 105 are the primary structure keeping the sections together around tubular 101.

Bands 105 may range in width from about ¼ inch to about 3 inches, for example from about ½ inch to 1½ inches. Slots 120 are made sufficiently large so that bands 105 can be easily inserted through slots 120 and installed about VIV suppression device 102. For example, slots 120 may be at least ¼ inch greater than the corresponding band, for example, from about ½ inch to about 1 inch greater than the corresponding band.

Although a single VIV suppression device 102 is shown attached to tubular 101, it is contemplated that any number of VIV suppression device 102 may be positioned around tubular 101. Representatively, it has been found that VIV suppression device 102 may sufficiently suppress VIV of tubular 101 at a coverage density of less than 70% of a length of a section of tubular 101. Thus, any number of VIV suppression device 102 sufficient to cover less than 70% of a section of tubular 101, for example, less than about 50% or from about 10% to about 30% of a section of tubular 101 may be used. Representatively, from about 2 to about 8 feet of VIV suppression device 102 in the case of a 12 foot tubular section may be used.

Still referring to FIG. 1B, bands 105 can be made of metal (such as stainless steel, metal alloy, or aluminum), plastic, synthetic materials, fiberglass, or other composite materials, or any suitable material capable of providing sufficient strength and longevity under the appropriate environmental conditions.

Collars 106 may be made of the same or different material than bands 105. Collars 106 may be of any size and shape suitable for attaching around tubular 101 and preventing VIV suppression device 102 from sliding axially along tubular 101. Representatively, in one embodiment, collars 106 may be substantially cylindrical structures that are divided into sections that may be opened and closed around tubular 101. Collars 106 may be secured in the closed position around tubular 101 by any suitable attachment mechanism, for example, bands, fasteners (e.g. bolt and bracket) or the like. In some embodiments, collars 106 may have a groove formed around its outer surface within which the band may fit so as to prevent the band from sliding off collar 106. Alternatively, a band attachment mechanism may be omitted and instead, collar 106 may include a hinge at one side and attachment mechanism at an opposite side to secure the sections of collar 106 together once it is positioned around tubular 101. Collars 106 may range in height from ¼ inch to 12 inches, for example, from about 1 inch to about 6 inches.

Figure 2A:
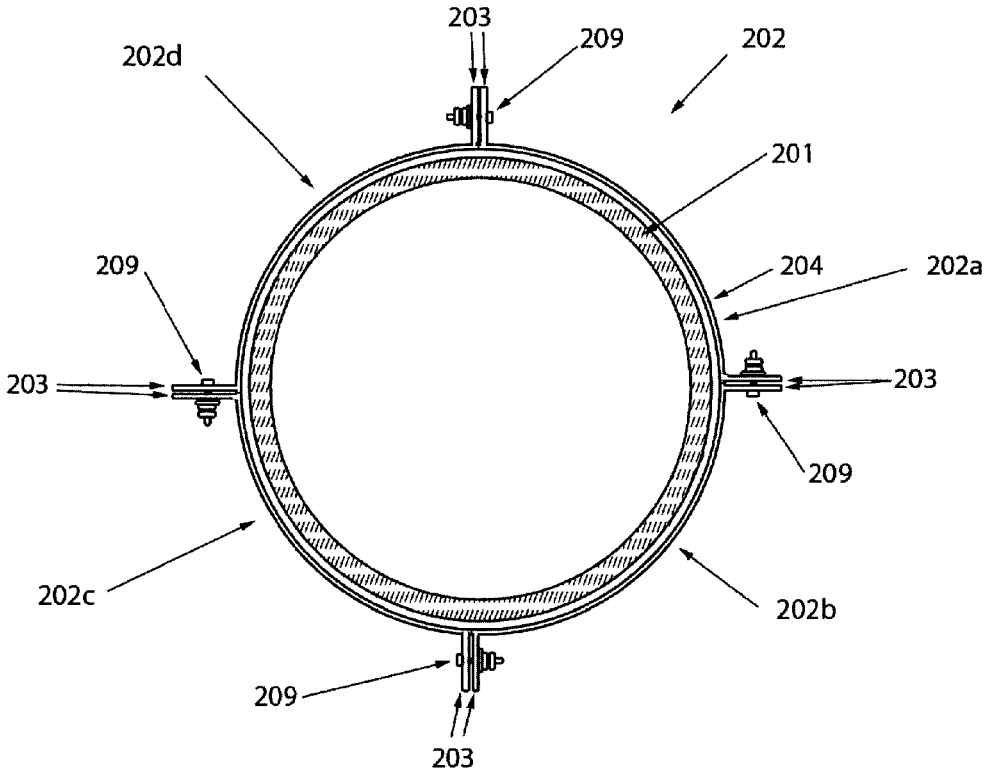
FIG. 2A illustrates a cross-sectional top view of another embodiment of a VIV suppression device.

FIG. 2A illustrates a cross-sectional top view of a VIV suppression device. VIV suppression device 202 may include body 204 having blades 203 extending therefrom. In some embodiments, body 204 forms a substantially cylindrical structure. Blades 203 may extend along a length dimension of body 204 and extend outward from body 204. Although four blades 203 are illustrated in FIG. 2A, it is contemplated that any number of blades suitable for suppressing VIV of tubular structure 201 may be used. Blades 203 may have a variety of shapes but should be sufficiently blunt such that oncoming current flow separates at, or near, the tip of the blade.

In this embodiment, body 204 of VIV suppression device 202 is divided into four circumferential sections 202A, 202B, 202C and 202D. Blades 203 may extend from each end of sections 202A, 202B, 202C and 202D. Adjacent sections are then attached to one another around tubular 201 through adjacent blades 103 by attachment mechanisms 209. Attachment mechanisms 209 may be any type of fastener suitable for securing sections 102A, 102B, 102*c* and 102*d* of VIV suppression device 102 together. Representatively, attachment mechanisms 209 may be bolts, screws, brackets, hooks, clips, hinges or the like.

Although FIG. 2A shows VIV suppression device 102 divided into four sections around the circumference of tubular 101, VIV suppression device 102 can be divided into any desired number of sections. For example, VIV suppression device 102 can be divided into two sections that are attached using blades 103, or three sections that are attached using blades 103. Alternatively, the sections may include blades within a middle portion of the section such that the sections are secured together using portions of device 202 other than blades 203, for example, a separate bracket and bolt system.

Blades 203 may be substantially similar to blades 103 described in reference to FIG. 1A, and may extend a distance from body (i.e. a length) that is substantially equal to about 3 percent of the diameter of tubular 101 to about 50 percent of the diameter of tubular 101, for example, from about 10 percent of the diameter of tubular 101 to about 25 percent of the diameter of tubular 101. VIV suppression device 202 may have a diameter of from about 101 percent of the diameter of tubular 101 to about 150 percent of the diameter of tubular 101. Attachment mechanism 209 may include mechanical fasteners such as bolts or screws, welds, clamps, chemical bonding, or any suitable attachment means. Each of attachment mechanism 209 may be made of any suitable size and it should be noted that the attachment mechanism of FIG. 2A (as well as any fasteners depicted in the rest of the figures of this document) are not to scale.

VIV suppression device 202 and blades 203 can be made of plastic (such as polyethylene, ABS, PVC, or other plastic material), metal (such as stainless steel or metal alloy), fiberglass or other composite material, wood, or any suitable material. VIV suppression device 202 and blades 203 may be made of the same material or different materials. For example, VIV suppression device 202 and blades 203 may be formed as one single integrally formed unit molded from a plastic material or extruded from a metal material. Alternatively, VIV suppression device 202 and blades 203 may be formed separately of different materials (or the same material) and attached to one another by any suitable attaching mechanism (e.g. bolts or screws).

Figure 2B:
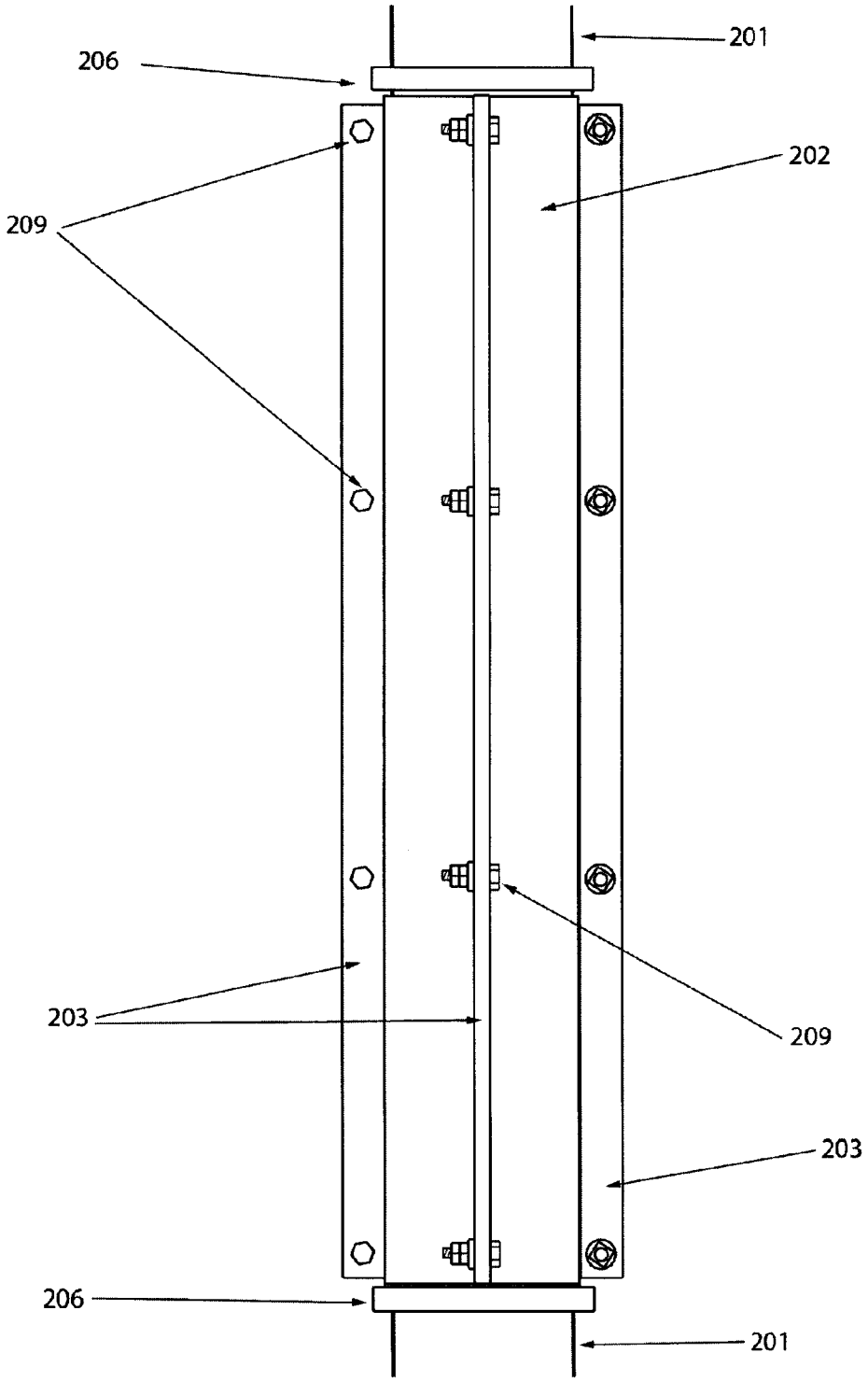
FIG. 2B illustrates a side view of the VIV suppression device of FIG. 2A.

FIG. 2B illustrates a side view of the VIV suppression device of FIG. 2A. VIV suppression device 202 is shown positioned around tubular 201 and restrained from axially sliding by collars 206. From this view, it can be seen that VIV suppression device 202 is divided circumferentially into sections as previously discussed and held together around tubular 201 by attachment mechanism 209. Attachment mechanism 209 may include any type of attachment mechanism such as bolts or screws, welds, clamps, chemical bonding, or any suitable attachment means.

Although a single VIV suppression device 202 is shown attached to tubular 201, it is contemplated that any number of VIV suppression device 202 may be positioned around tubular 201. Representatively, any number of VIV suppression device 102 sufficient to cover from about 10% to about 40% of a section of tubular 101 may be used, for example, from about 2 to about 8 of VIV suppression device 102 in the case of a 12 foot tubular section.

Collar 206 may be substantially similar to collar 106 described in reference to FIG. 1A. For example, collar 206 may be divided into sections and held in place around tubular 201 using a band. Additionally or alternatively, sections of collar 206 may be held in place around tubular 201 using any suitable means including hinges, latches, clamps, welds, chemical bonding, fastening (with or without support structures or other appurtenances) and more than one means can be utilized for each collar or tubular.

Figure 3:
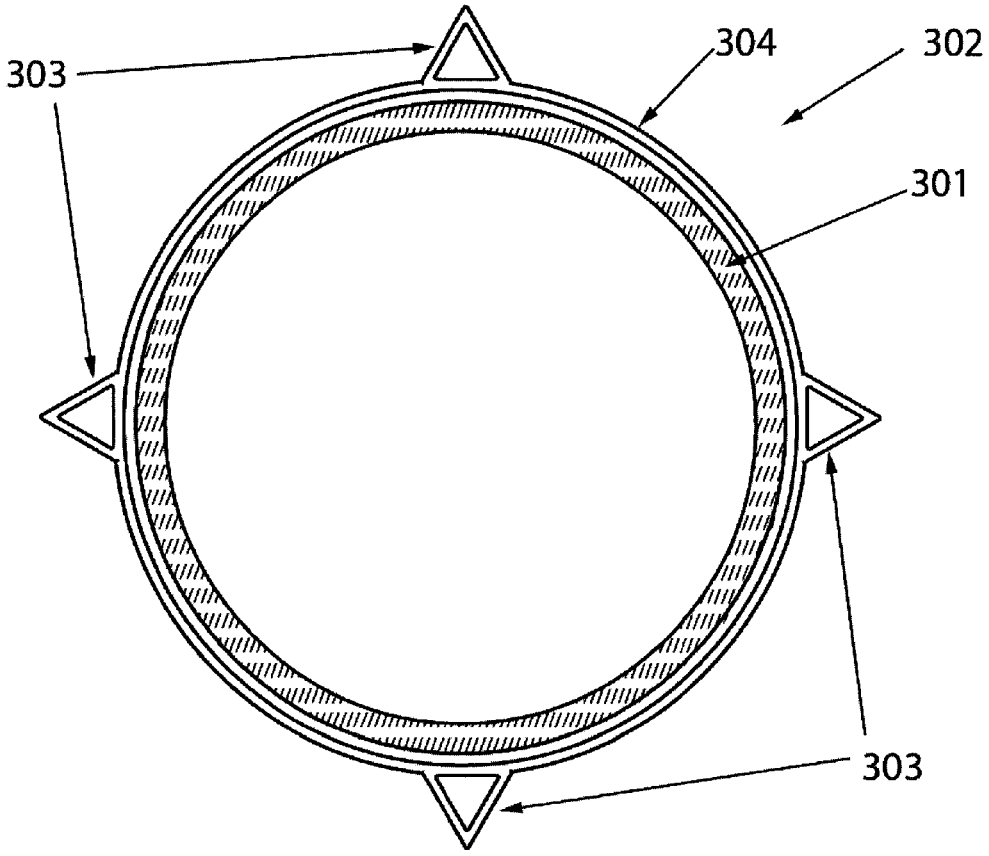
FIG. 3 illustrates a cross-sectional top view of another embodiment of a VIV suppression device.

FIG. 3 illustrates a cross-sectional top view of another embodiment of a VIV suppression device. VIV suppression device 302 may include a substantially cylindrical body 304 having blades 303 extending therefrom. Body 304 and blades 303 may be substantially similar to the body and blades described in reference to FIG. 1A except in this embodiment, blades 303 have a substantially triangular cross-sectional shape. Blades 303 may be attached to body 304 as separate structures or may be molded as part of body

304. Blades 303 may be molded, extruded, formed (with or without heat or cold), welded, or made by any suitable means.

Blades 303 may extend a distance from body (i.e. a length) that is substantially equal to about 3 percent of the diameter of tubular 101 to about 50 percent of the diameter of tubular 101, for example, from about 10 percent of the diameter of tubular 101 to about 25 percent of the diameter of tubular 101. Blades 303 may have the same or different height than VIV suppression device 302. VIV suppression device 302 will range in height from about 101 percent of the diameter of tubular 301 to about 150 percent of the diameter of tubular 301.

Body 304 and blades 303 can be made of plastic (such as polyethylene, ABS, PVC, or other plastic material), metal (such as stainless steel or metal alloy), fiberglass or other composite material, wood, or any suitable material.

In some embodiments, body 304 of VIV suppression device 302 may be divided into sections that can be separated so that device 302 may be placed around underlying tubular 301. The sections of body 304 may be attached together around tubular 301 using any of the previously disclosed mechanisms, e.g. bolts, brackets, screws or bands. In still further embodiments, blades 303 of VIV suppression device 302 may have mating pieces that facilitate securing adjacent sections of VIV suppression device 302 together.

Figure 4:
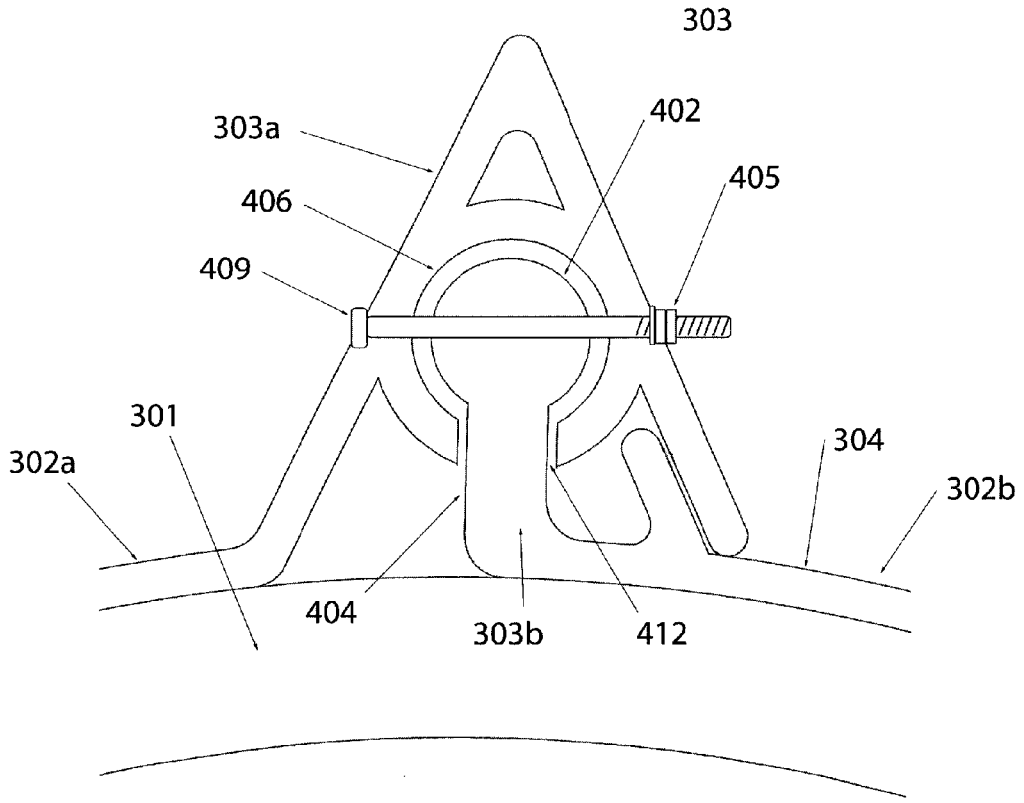
FIG. 4 illustrates a cut out cross-sectional side view of an embodiment of the blade illustrated in FIG. 3.

FIG. 4 illustrates a cut out cross-sectional view of an embodiment of the blade illustrated in FIG. 3. As previously discussed, blade 303 may have a triangular cross-sectional shape. From this view, it can be seen that blade 303 may include interlocking portions 303A and 303B which interlock with one another to hold sections 302A and 302B of VIV suppression device 302 together. In particular, blade 303 includes a first interlocking portion 303A attached to section 302A of VIV suppression device 302 and second interlocking portion 303B attached to section 302B. First interlocking portion 303A may include a female piece 406 and second interlocking portion 302B may include a male piece 402 that can be received by female piece 406. Representatively, female piece 406 may be a cylindrical cavity that runs along a height of blade 303 and includes opening 412 at one side. Female piece 406 may be integrated within an interior portion of blade 303. Male piece 402 may be a cylindrical piece that is attached to section 302B by arm 404. Arm 404 is at a substantially 90 degree angle to section 302A and male piece 402 attaches to the free end of arm 404. Opening 412 is wide enough to receive arm 404 but narrower than the cylindrical end portion of male piece 402. In this aspect, male piece 402 can be inserted within female piece 406 by, for example, increasing a size of opening 412 and snapping male piece 402 through opening 412 into position. Alternatively, male piece 402 may be aligned with an open end of female piece 406 found at the top or bottom of blade 303 and male piece 402 may slide vertically to position it within female piece 406. Once male piece 402 is inserted within female piece 406, female piece 406 encircles a substantial portion of male piece 402 such that it cannot be removed by movement in a direction normal to an axis of tubular 301. While female piece 406 and male piece 402 can slide axially along the pipe (in and out of the page of FIG. 4), a collar or other mechanism is sufficient to keep them in place.

An optional bolt 409 and nut assembly 405 may further be inserted through interlocking portions 303A and 303B to strengthen their attachment. Other optional attachment mechanisms may include other mechanical methods (such as screws, clamps, welds, etc.), or chemical methods (e.g. chemical bonding). Although interlocking portions 303A, 303B are only shown at one end of sections 302A, 302B, it is contemplated that each section may include a female interlocking portion 303A and male interlocking portion 303B at each end such that when each section is assembled together, adjacent ends can interlock in the manner previously discussed.

Although FIG. 4 illustrates female piece 406 and male piece 402 having complimentary cylindrical shapes, they may be made of any suitable geometry. For example, female piece 406 may have any size and shape sufficient to receive and lock male piece 402 therein, e.g. square, triangle, elliptical or the like.

Interlocking portions 303A and 303B may extend along the entire height dimension of blade 303 such that they have the same height as blade 303 or may have a different height.

Female piece 406 and male piece 402 may be made of the same or different material as each other and as blade 303. Representatively, female piece 406 and male piece 402 may be made of plastic (such as polyethylene, ABS, PVC, or other plastic material), metal (such as stainless steel or metal alloy), fiberglass or other composite material, wood, or any suitable material.

Figure 5:
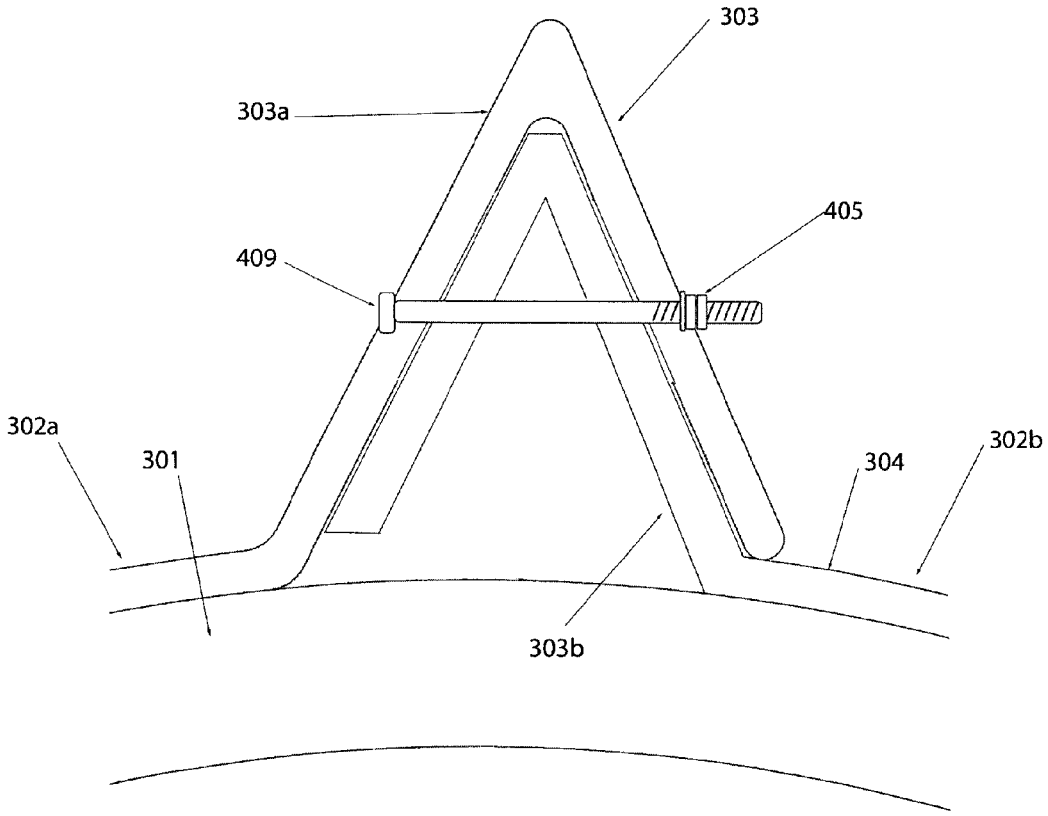
FIG. 5 illustrates a cut out cross-sectional side view of another embodiment of the blade illustrated in FIG. 3.

FIG. 5 illustrates a cut out cross-sectional view of another embodiment of the blade illustrated in FIG. 3. Blade 303 may be substantially the same as the blade discussed in reference to FIG. 4 except in this embodiment, interlocking portions 303A and 303B have different geometries. In particular, according to this embodiment, female interlocking portion 303A is a substantially hollow triangular structure and male interlocking portion 303B has a triangular shape complimentary to female interlocking portion 303A. Male interlocking portion 303B may be positioned within female interlocking portion 303A to lock sections 302A and 302B together by deforming one of portions 303A, 303B or sliding section 303B axially within an end of portion 303A as previously discussed. Optional bolt 409 and nut assembly 405 may be used to further secure female interlocking portion 303A to male interlocking portion 303B. Other attachment mechanisms are also possible including other mechanical methods (such as screws, clamps, welds, etc.), or chemical methods (e.g., chemical bonding).

Figure 6:
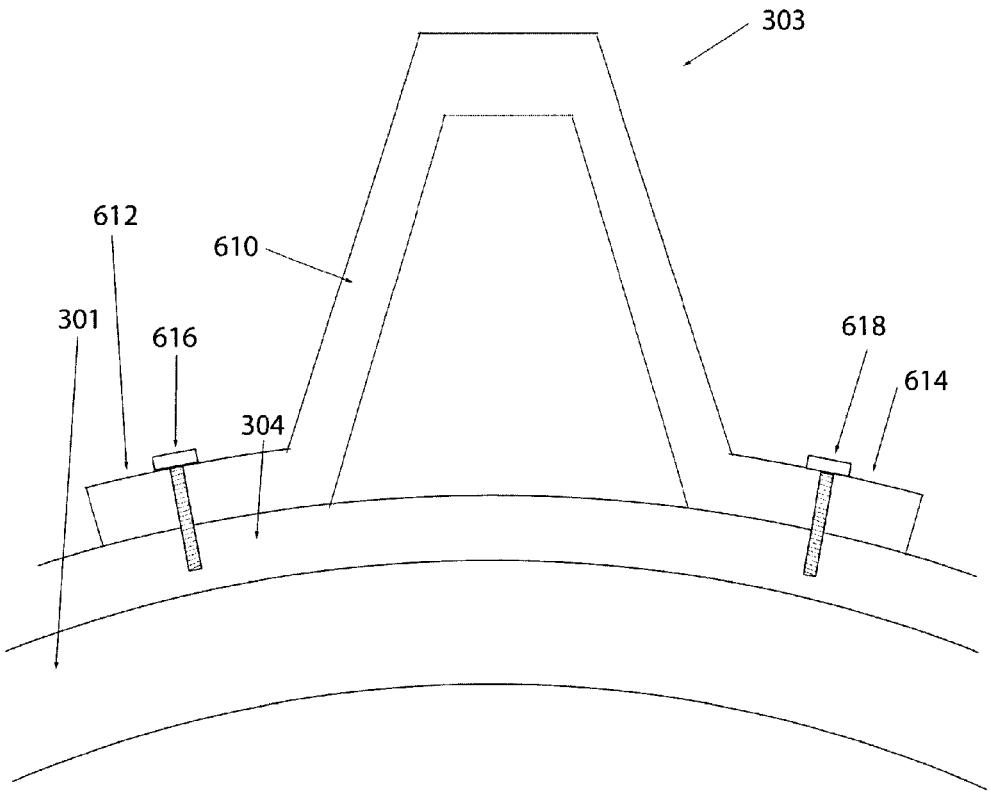
FIG. 6 illustrates a cut out cross-sectional side view of another embodiment of the blade illustrated in FIG. 3.

Alternatively, instead of blade 303 being separated into interlocking portions as previously discussed, blade 303 may be a single unit that is attached to a desired portion of VIV suppression device body 304 as illustrated in FIG. 6. Representatively, blade 303 may be a hollow structure having, in this case, a substantially cone or trapezoidal shape, but may have other geometries such as rectangular, elliptical, circular, triangular, etc. Blade 303 may include legs 612, 614 that extend outwardly, from the sides of blade 303 and can be used to mount blade 303 to body 304. For example, attachment mechanisms 616, 618 (e.g., bolt) may be inserted through legs 612, 614, respectively, and through body 304 to attach blade 303 to body 304. Although mechanical attachment mechanisms 616, 618 are illustrated it is contemplated that any mechanism suitable for attaching blade 303 to body 304 may be used, for example, welding, clamping, chemical bonding, or any suitable means including combinations of fastening methods.

Blade 303, body 304, and attachment mechanisms 616, 618 may be made of the same or different material, for example, plastic (such as polyethylene, ABS, PVC, or other plastic material), metal (such as stainless steel or metal alloy), fiberglass or other composite material, wood, or any suitable material.

Figure 7:
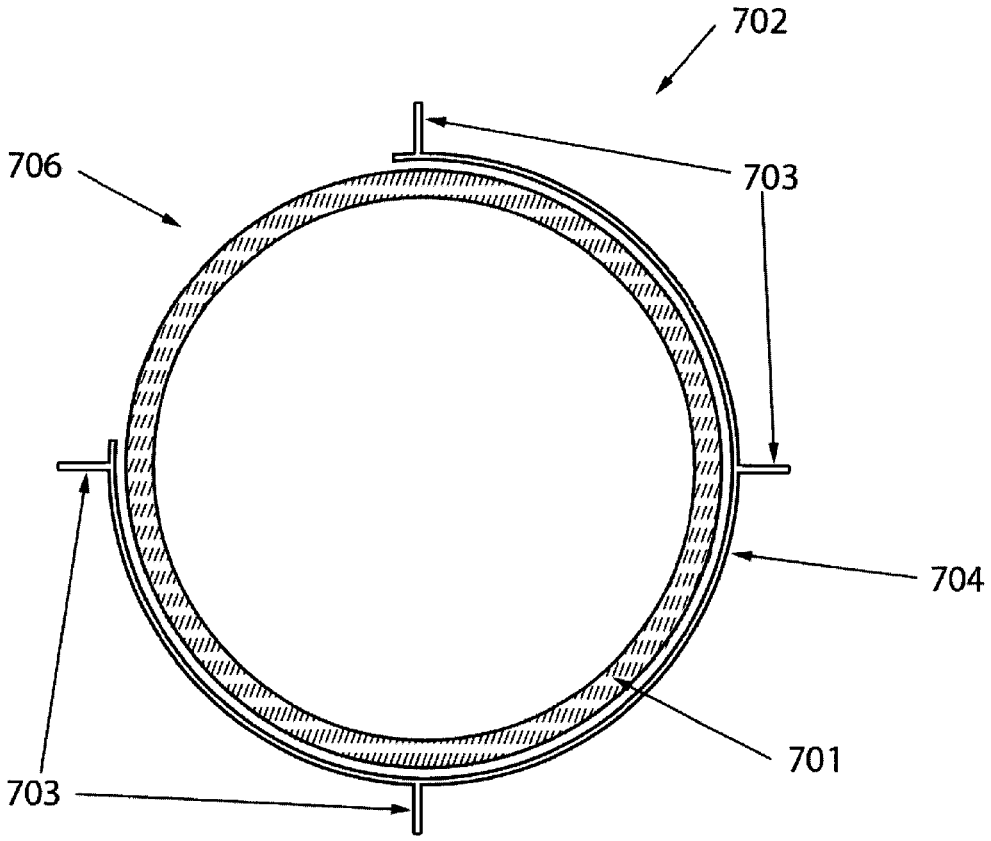
FIG. 7 illustrates a top cross-sectional view of another embodiment of a VIV suppression device.

FIG. 7 illustrates a top cross-sectional view of another embodiment of a VIV suppression device. VIV suppression device 702 includes blades 703 that extend outwardly from body portion 704 similar to the blade/body configurations that have been previously discussed. In this embodiment, however, body 704 does not completely encircle tubular 701. Rather, body 704 includes opening 706 formed within a portion of its circumference to facilitate positioning of VIV suppression device 702 around tubular 701. Representatively, VIV suppression device 702 can be spread apart at opening 706 and placed around tubular 701. In this aspect, body 704 may have a sufficient flexibility and resiliency such that it is flexible enough to be opened and closed around tubular 701 yet sufficiently stiff to withstand any environmental forces and stay around tubular 701 once it is installed. In addition, opening 706 must be large enough to allow tubular 701 to be inserted through opening 706 but small enough such that once body 704 is placed around tubular 701, tubular 701 cannot fit through opening 701 without user intervention. Representatively, opening 706 can range in circumferential size from about 1 percent of the circumference of tubular 701 to about 180 percent of the circumference of tubular 701, for example, from less than 1 percent of the circumference of tubular 701 to about 120 percent of the circumference of tubular 701. In addition, it is contemplated that were additional support is needed, structures (e.g. bolts, bands or straps) may be attached to the free ends of body 704 and across opening 706 to provide added support.

Blades 703 may have a substantially similar size and shape and be made of substantially the same material as the blades previously discussed.

Figure 8A:
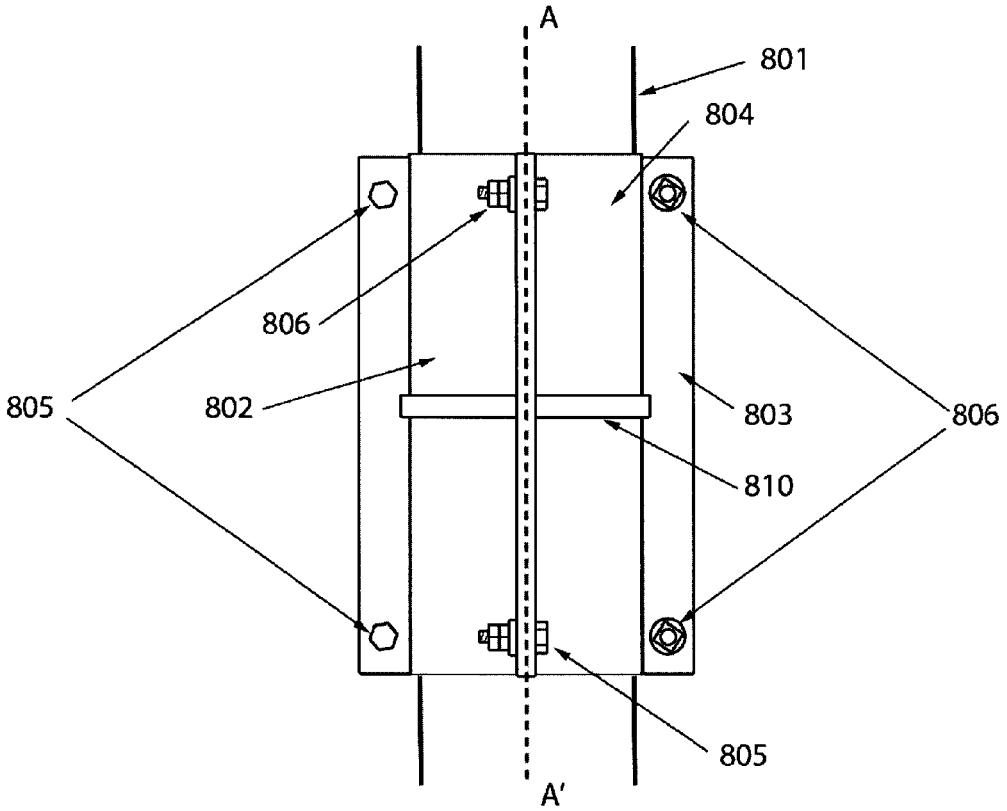
FIG. 8A illustrates a side view of another embodiment of a VIV suppression device.

FIG. 8A illustrates a side view of another embodiment of a VIV suppression device. VIV suppression device 802 is shown placed around tubular 801. VIV suppression device 802 may be made of multiple sections as previously discussed that include a body portion 804 having blades 803 extending therefrom. The sections may be fastened together at blades 803 using any suitable attachment mechanism. Representatively, the attachment mechanism may be bolts 805 that are inserted through blades 803 and secured in place with nut assemblies 806. VIV suppression device 802 may be substantially similar to any of the previously disclosed VIV suppression devices, for example, device 202 discussed in reference to FIG. 2A except that in this embodiment, channel 810 is formed along device 802 to accommodate an internal collar. In one embodiment, channel 810 is formed along an interior surface of body portion 804. The internal collar restrains VIV suppression device 802 from sliding axially while still allowing device 802 to rotate around tubular 801.

Channel 810 may be a closed channel that surrounds the internal collar, any type of opening that allows the internal collar to pass through, or any other partial channel or conduit that accommodates the internal collar. Channel 810 may be any size suitable for accommodating an internal collar while still allowing device 802 to weathervane around tubular 801. For example, collar 808 may range in height from about ¼ inch to about 12 inches, for example, from about 1 inch to about 6 inches. Channel 810 will have a height greater than collar 808, for example, a height that is about ½ inch to about an inch greater than the height of collar 808 without impeding weathervaning of device 802 about tubular 801 (i.e., channel 810 should not contact tubular 801) for example, a depth less than a thickness of collar 808.

During operation, the internal collar (not shown) is first installed on tubular 801, and then VIV suppression device 802 is installed over the internal collar so that internal collar is positioned within channel 810. While FIG. 8A shows VIV suppression device 802 made up of sections that are fastened together at the blades, channel 810 may be formed within any VIV suppression device 802, for example sections that are banded together as previously discussed.

Figure 8B:
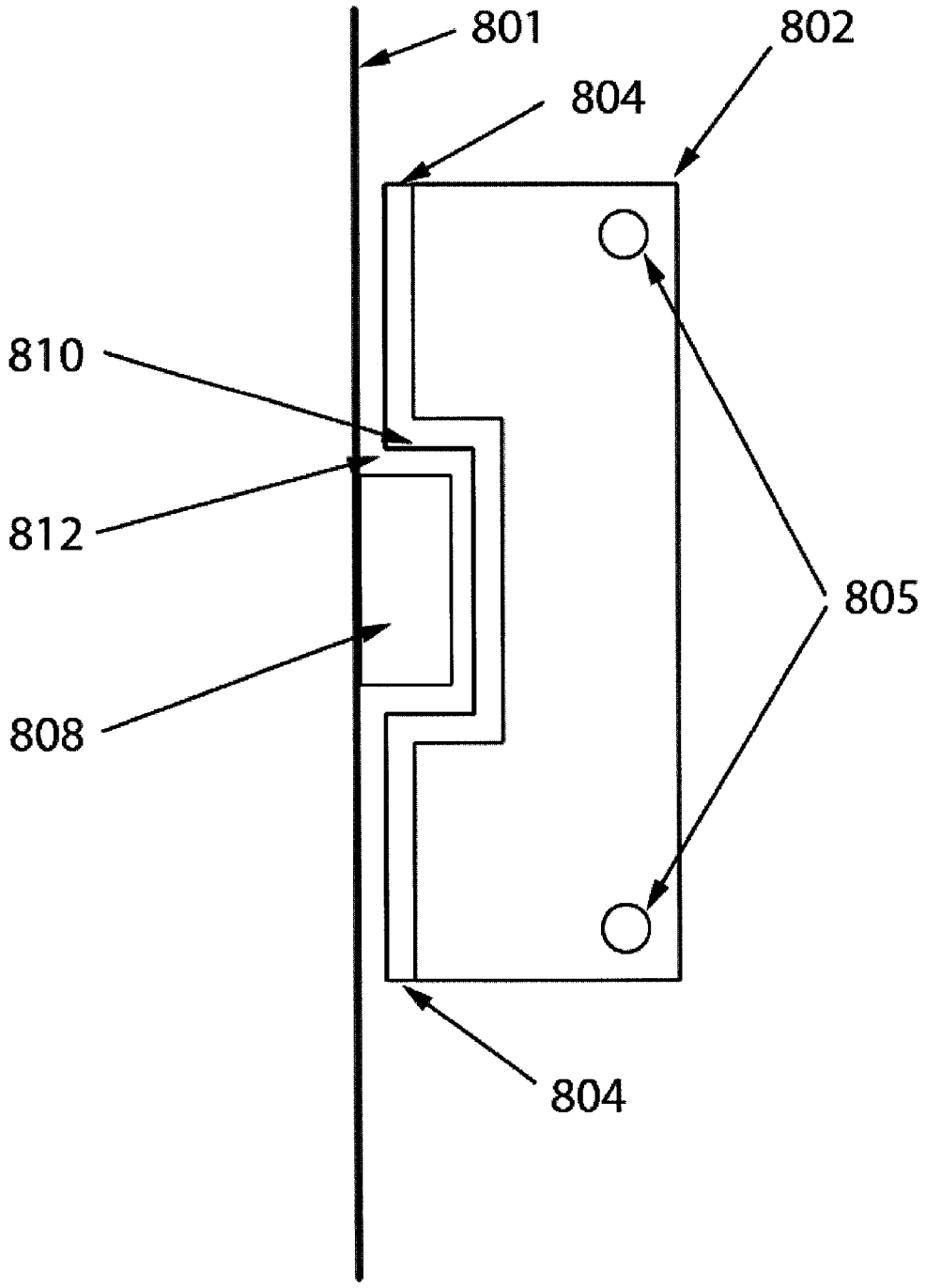
FIG. 8B illustrates a cross-sectional side view of an embodiment of the VIV suppression device of FIG. 8A along line A-A'.

FIG. 8B illustrates a cross-sectional side view of an embodiment of the VIV suppression device of FIG. 8A along line A-A'. From this view the dimensions of one embodiment of channel 810 and collar 808 can be seen. In particular, channel 810 is formed as a recessed region along an interior surface of body 804. Channel 810 may have any shape and dimensions suitable for receiving collar 808. Representatively, channel 810 may have a substantially rectangular shape with opening 812 along one side so that collar 808 can be inserted within channel 810. Channel 810 may be fabricated separately from body 804 or may be an opening formed within body 804. Once collar 808 is inserted within channel 810, VIV suppression device 802 vertical movement is restricted by collar 808 through interference between collar 808 and the sidewalls of channel 810.

Figure 8C:
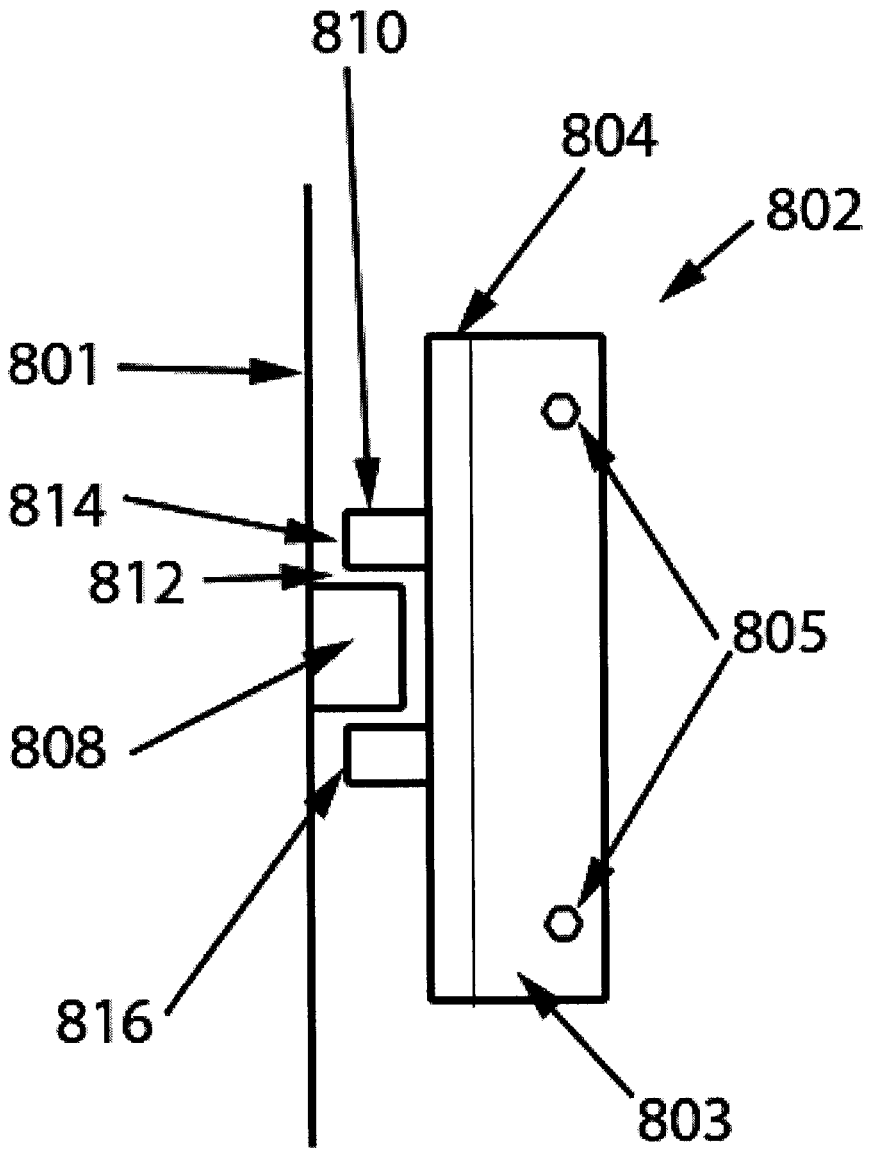
FIG. 8C illustrates a cross-sectional side view of another embodiment of the VIV suppression device of FIG. 8A along line A-A'.

FIG. 8C illustrates a cross-sectional side view of another embodiment of the VIV suppression device of FIG. 8A along line A-A'. From this view, the dimensions of another embodiment of channel 810 and collar 808 can be seen. In this embodiment, channel 810 is formed by arms 814 and 816 which extend from an interior surface of body 804 to define a channel dimensioned to receive collar 808. Arms 814, 816 may be integrally formed with body 804 or as separate pieces and then attached to body 804 by any suitable attachment means, e.g. bolt, screw, welding, chemical process of the like. Channel 810 may have any shape and dimensions suitable for receiving collar 808. Representatively, channel 810 may have a substantially rectangular shape with opening 812 along one side so that collar 808 can be inserted within channel 810.

Figure 8D:
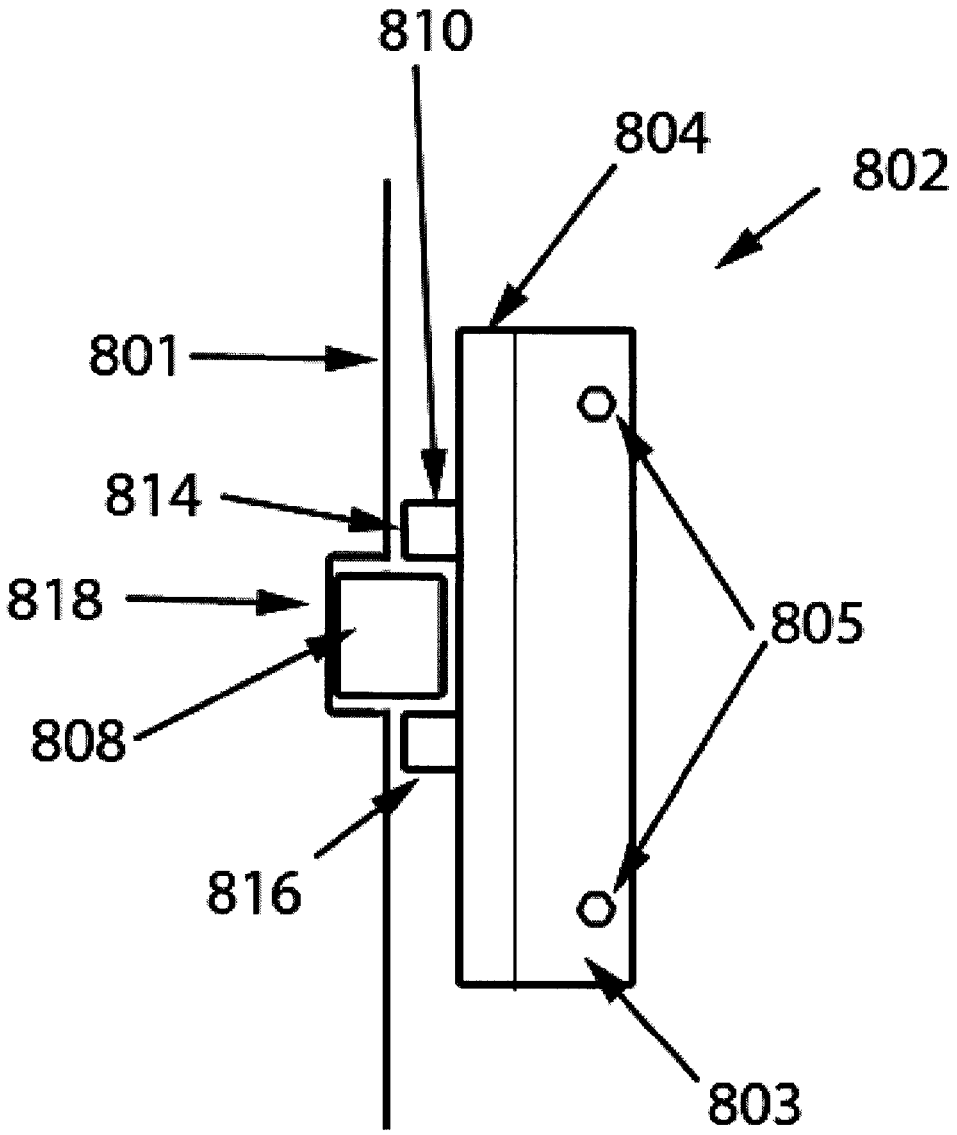
FIG. 8D illustrates a cross-sectional side view of another embodiment of the VIV suppression device of FIG. 8A along line A-A'.

FIG. 8D illustrates a cross-sectional side view of another embodiment of the VIV suppression device of FIG. 8A along line A-A'. VIV suppression device 802 is substantially similar to the device disclosed in reference to FIG. 8C except in this embodiment collar 808 is partially inserted into slot 818 formed around tubular 801. Once collar 808 is inserted into slot 818, the slot sidewalls will prevent collar 808, and in turn the associated VIV suppression device 802, from moving vertically along tubular 801. In this aspect, slot 818 may have any shape and dimensions sufficient to receive a portion of collar 808 and restrain collar 808 from moving vertically along tubular 801. For example, slot 818 may have a height greater than collar 808, for example, a height that is about ½ inch to about an inch greater than the height of collar 808. Slot 818 may have a depth sufficient to restrain vertical movement of collar 808 while still allowing a portion of collar 808 to extend beyond tubular 801 and within channel 810, for example, a depth less than a thickness of collar 808. Slot 818 may be formed within any portion of an outer surface of tubular 801, for example, in a buoyancy layer, insulation layer, or any other component or layer associated with tubular 801 within which it is possible to construct a slot by any suitable process, e.g. a mechanical or chemical process suitable for excising a portion of a material.

Figure 8E:
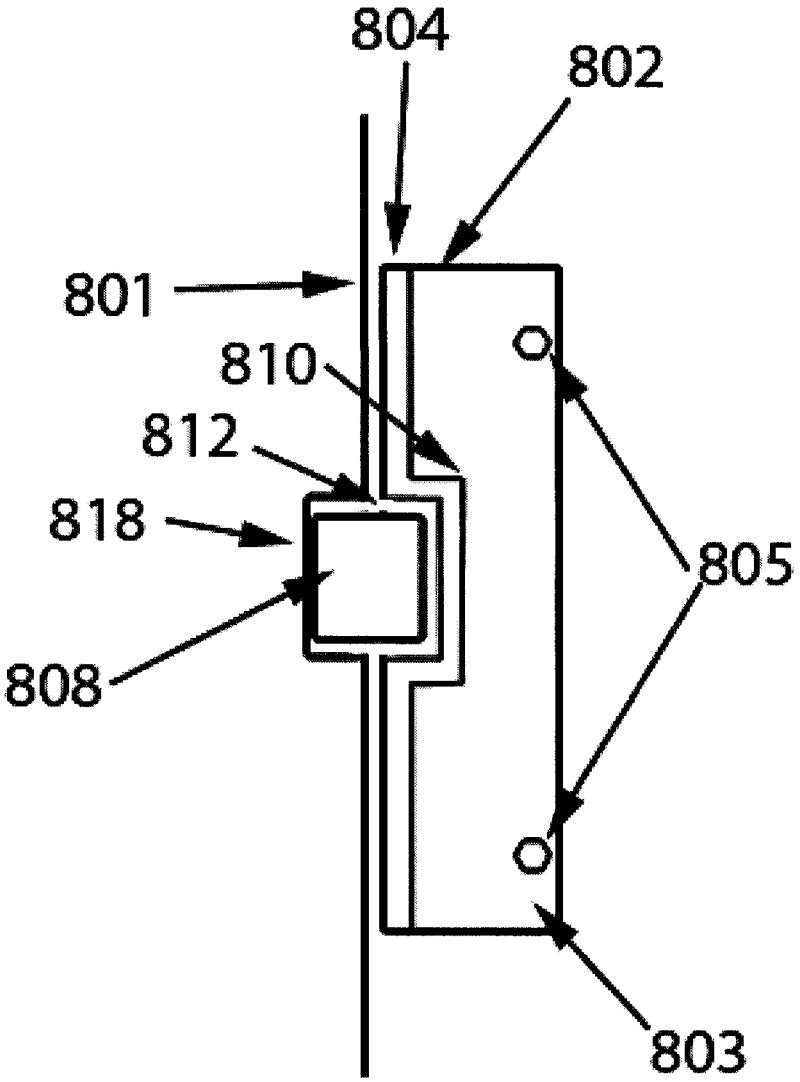
FIG. 8E illustrates a cross-sectional side view of another embodiment of the VIV suppression device of FIG. 8A along line A-A'.

FIG. 8E illustrates a cross-sectional side view of another embodiment of the VIV suppression device of FIG. 8A along line A-A'. VIV suppression device 802 is substantially similar to the device disclosed in reference to FIG. 8B except in this embodiment, collar 808 is shown partially inserted into slot 818 formed around tubular 801 as described in reference to FIG. 8D. Since collar 808 is inserted within slot 818 on one side and channel 810 of VIV suppression device 802 on another side, VIV suppression device 802 is prevented from moving vertically along tubular 801.

Figure 9:
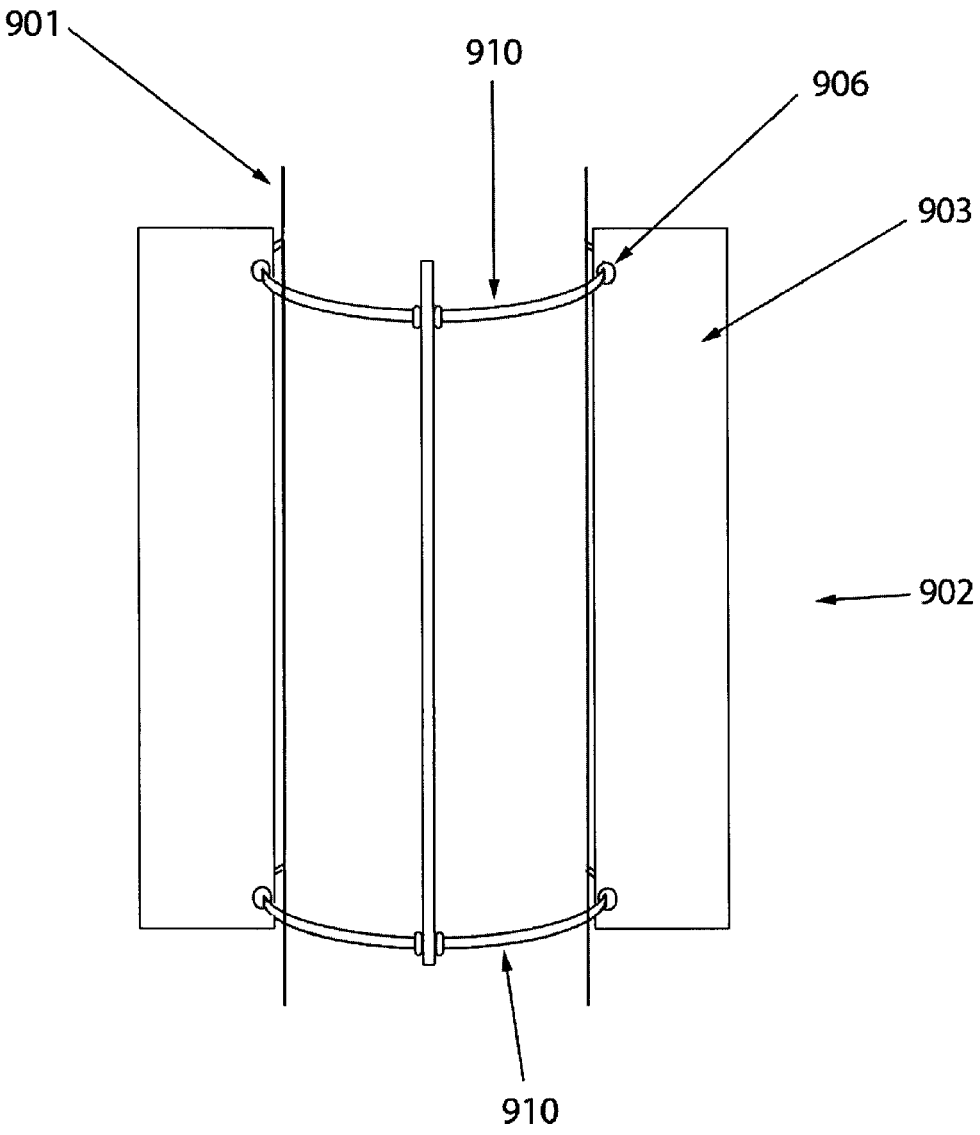
FIG. 9 illustrates a side view of another embodiment of a VIV suppression device.

FIG. 9 illustrates a side view of another embodiment of a VIV suppression device. In this embodiment, VIV suppression device 902 includes blades 903 such as those previously discussed except in this embodiment, the body portion is omitted and instead, blades 903 are separable blades attached to tubular 901 using ring members 910. Ring members 910 may be made of the same or different material as the previously described bands and have similar dimensions, or may be narrower or wider than the previously described bands. Blades 903 include apertures 906 along a base portion. Ring members 910 may be inserted through apertures 906 and wrapped around tubular 901 and secured at opposing ends to fasten blades 903 to tubular 901. Clamps may further be provided to secure blades 903 at a desired location around ring members 910 so that a spacing between blades 903 can be set and maintained around tubular 901. In addition, one or more collars could be provided around tubular 901 and at the ends of blades 903 to secure blades 903 in the vertical orientation. Although two ring members 910 are illustrated, it is contemplated that any number of ring members 910 may be used depending, for example, on the height of VIV suppression device.

Figure 10:
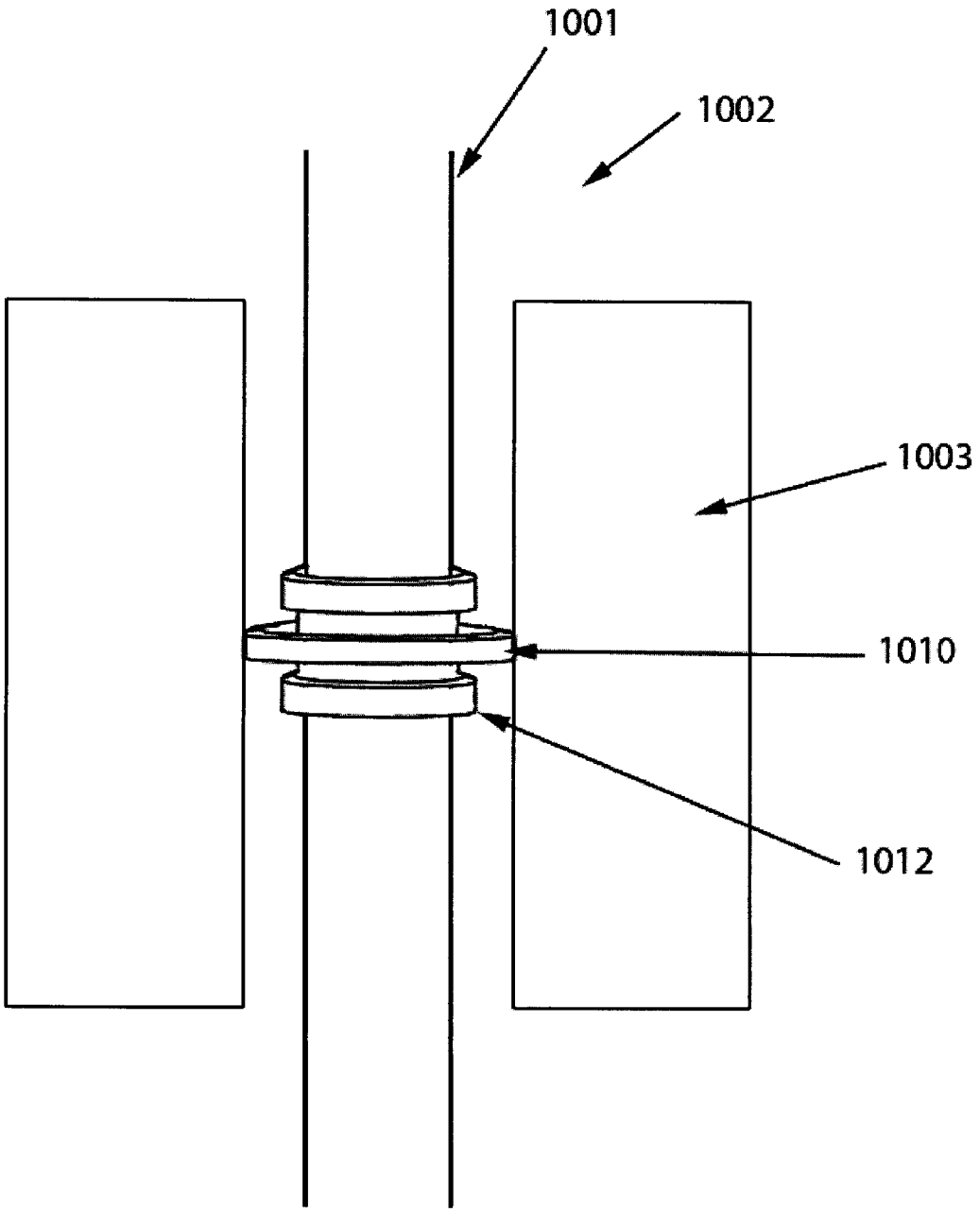
FIG. 10 illustrates a side view of another embodiment of a VIV suppression device.

FIG. 10 illustrates a side view of another embodiment of a VIV suppression device. VIV suppression device 1002 is similar to VIV suppression device 902 in that it includes blades 1003 and the body portion is omitted. In addition, ring member 1010 is attached to blades 1003 at a desired location and ring member 1010 is wrapped around collar 1012 and secured at opposing ends to hold blades 1003 around tubular 1001. Blades 1003 may be fixedly attached to ring member 1010 using, for example, bolts or other fastening mechanism, so that blades 1003 do not move around tubular 1001. In this embodiment, ring member 1010 is positioned around tubular 1001 within a channel of collar 1012 that is positioned around tubular 1001 so that blades 1003 are prevented from sliding vertically along tubular 1001.

In broad embodiments, the present invention is directed to a VIV suppression device that is held adjacent to a tubular and is made of two or more sections with minimal vertical movement due to the presence of one or more thrust collars. The VIV suppression device may be fixed to the tubular or free to rotate around the tubular or a combination of multiple VIV suppression devices, some of which are fixed and others free to rotate. Where the VIV suppression device is fixed to the tubular, the collar(s) is optional and the tubular cross section does not have to be circular (i.e. the device may be applied to any structure other than a tubular structure that could benefit from VIV suppression). Also, for all variations of VIV suppression devices presented herein, any number and size of blades may be used. The blades may also vary in size for each individual device.

It should also be appreciated that reference throughout this specification to "one embodiment", "an embodiment", or "one or more embodiments", for example, means that a particular feature may be included in the practice of the invention. Similarly, it should be appreciated that in the description various features are sometimes grouped together in a single embodiment, Figure, or description thereof for the purpose of streamlining the disclosure and aiding in the understanding of various inventive aspects. This method of disclosure, however, is not to be interpreted as reflecting an intention that the invention requires more features than are expressly recited in each claim. Rather, as the following claims reflect, inventive aspects may lie in less than all features of a single disclosed embodiment. Thus, the claims following the Detailed Description are hereby expressly incorporated into this Detailed Description, with each claim standing on its own as a separate embodiment of the invention.

In the foregoing specification, the invention has been described with reference to specific embodiments thereof. It will, however, be evident that various modifications and changes can be made thereto without departing from the broader spirit and scope of the invention as set forth in the appended claims. For example, the VIV suppression devices disclosed herein may be applied to any structure other than a tubular structure that could benefit from VIV suppression. The specification and drawings are, accordingly, to be regarded in an illustrative rather than a restrictive sense.

What is claimed is:

1. An apparatus comprising:

an inflexible body having a cylindrical shape and dimensioned to surround an underlying structure capable of experiencing a vortex induced vibration, the body having a first section and a second section, the first section having a first edge and a second edge parallel to a longitudinal axis of the body and the second section has a first edge and a second edge parallel to the longitudinal axis of the body, and the first edge of the first section is attached to the first edge of the second section by a hinge, and the second edge of the first section and the second edge of the second section are separable from one another such that the body is operable to be positioned around an underlying structure and the body is free to rotate around an underlying structure;

at least four substantially straight and inflexible blade members, wherein at least two of the substantially straight and inflexible blade members extend from a portion of the first section adjacent an underlying tubular and at least two of the substantially straight and inflexible blade members extend from a portion of the second section adjacent an underlying structure, wherein a length dimension of each of the blade members is parallel to the longitudinal axis of the body and the blade members are substantially evenly circumferentially spaced around the body, and wherein each of the blade members are a single, integrally formed unit dimensioned to suppress the vortex induced vibration of the structure when the body is positioned around the structure; and an interlocking assembly for holding the second edge of the first section and the second edge of the second section in a closed configuration around an underlying tubular, wherein the interlocking assembly comprises a first interlocking member formed by one of the blade members extending from the first section and a second interlocking member formed by one of the blade members extending from the second section, wherein the first interlocking member and the second interlocking member are capable of interlocking with one another to secure the first section to the second section in the closed configuration.

2. The apparatus of claim 1 wherein at least one of the blade members comprises a slot dimensioned to receive a band member for securing the first section and the second section around the structure.

3. The apparatus of claim 1 wherein at least one of the blade members comprises a substantially triangular shape.

4. The apparatus of claim 1 wherein the first interlocking member comprises a first substantially hollow triangular structure extending from the second edge of the first section and the second interlocking member comprises a second substantially hollow triangular structure extending from the second edge of the second section, wherein the second substantially hollow triangular structure is dimensioned to fit within the first substantially hollow triangular structure.

5. The apparatus of claim 1 wherein the first section and the second section are dimensioned to cover less than an entire circumference of the structure.

6. The apparatus of claim 1 wherein a channel is formed along an interior surface of the body, the channel dimensioned to receive a collar positioned around the structure so as to restrain vertical movement of the body about the structure.

7. The apparatus of claim 6 wherein a recess is formed around the structure, wherein the recess is dimensioned to receive the collar so as to prevent vertical movement of the collar about the structure.

8. An apparatus comprising:

a cylindrical body dimensioned to surround a tubular capable of experiencing a vortex induced vibration (VIV), the cylindrical body having a first section, a second section, a third section, and a fourth section capable of being separated and positioned around a tubular; and at least two blade members that are approximately 90 degrees apart extend from each of the first section, the second section, the third section and the fourth section, and wherein each of the first section, the second section, the third section and the fourth section have at least one of the blade members extending substantially perpendicular to an end of the section that is parallel to a longitudinal axis of the body and that interfaces with another section, and wherein the blade members are directly attached to one another when the cylindrical body is positioned around a tubular, and the blade members having a length dimension parallel to a longitudinal axis of the body and dimensioned to suppress a vortex induced vibration of a tubular when the cylindrical body is positioned around a tubular.

9. The apparatus of claim 8 wherein the blade member comprises a slot dimensioned to receive a band member for securing the first section and the second section around the structure.

10. The apparatus of claim 8 further comprising a first interlocking member attached to the first section and a second interlocking member attached to the second section, wherein the first interlocking member and the second interlocking member are capable of interlocking with one another to secure the first section to the second section around the structure.

11. The apparatus of claim 10 wherein the first interlocking member and the second interlocking member are enclosed within the blade member.

12. The apparatus of claim 8 wherein the first section and the second section, the third section and the fourth section are dimensioned to cover less than an entire circumference of the structure.

13. The apparatus of claim 8 wherein a channel is formed along an interior surface of the cylindrical body, the channel dimensioned to receive a collar positioned around the structure so as to restrain vertical movement of the cylindrical body about the structure.

14. A method of suppressing vortex induced vibration (VIV) about a structure comprising:

positioning a plurality of VIV suppression devices around a structure, each of the VIV suppression devices comprising a cylindrical body member having at least four separable sections operable to encircle the structure and each of the sections having at least two substantially straight blade members having a length dimension parallel to a longitudinal axis of the body member, the blade members being substantially evenly spaced in a circumferential direction around the structure and directly connected to an outer surface of a portion of the cylindrical body member adjacent the structure and having a rectangular cross-sectional shape with the length dimension extending outward from the outer surface of the cylindrical body member, the cross-section being taken perpendicular to a length of the blade member and wherein the plurality of VIV suppression devices cover less than 70% of a section of the structure.

15. The method of suppressing VIV of claim 14 wherein positioning comprises:

positioning the body member around the structure; and inserting a strap through the blade member and around the body member.

16. The method of suppression VIV of claim 14 wherein positioning comprises:

positioning the body member around the structure; and inserting a collar positioned around the structure within a channel formed along an interior surface of the body member.

* * * * *